US008701231B2

(12) United States Patent
Malet

(10) Patent No.: US 8,701,231 B2
(45) Date of Patent: Apr. 22, 2014

(54) SECURE FALL-PREVENTION MAT

(76) Inventor: Pascale Malet, La Ciotat (FR)

( * ) Notice: Subject to any disclaimer, the term of this patent is extended or adjusted under 35 U.S.C. 154(b) by 0 days.

(21) Appl. No.: 13/383,121

(22) PCT Filed: Jul. 5, 2010

(86) PCT No.: PCT/FR2010/051414
§ 371 (c)(1),
(2), (4) Date: Feb. 8, 2012

(87) PCT Pub. No.: WO2011/004112
PCT Pub. Date: Jan. 13, 2011

(65) Prior Publication Data

US 2012/0159708 A1 Jun. 28, 2012

(30) Foreign Application Priority Data

Jul. 9, 2009 (FR) ..... 09 03382
May 21, 2010 (FR) ..... 10 02146

(51) Int. Cl.
*A47D 13/08* (2006.01)
*A47D 15/00* (2006.01)

(52) U.S. Cl.
USPC ..... 5/655; 5/424

(58) Field of Classification Search
USPC ..... 5/411, 739, 424, 417, 420, 655, 694, 5/702, 655.4, 911; 128/870
See application file for complete search history.

(56) References Cited

U.S. PATENT DOCUMENTS

| | | | | |
|---|---|---|---|---|
| 3,659,297 | A | 5/1972 | Schutz | |
| 3,721,434 | A * | 3/1973 | Spies | 5/655 |
| 4,712,258 | A | 12/1987 | Eves | |
| 5,566,413 | A | 10/1996 | Webb et al. | |
| 6,389,624 | B1 * | 5/2002 | Madole | 5/655 |
| 6,755,198 | B2 * | 6/2004 | Parker | 128/870 |
| 7,059,000 | B2 * | 6/2006 | Verbovszky | 5/655 |
| 7,065,814 | B2 * | 6/2006 | Rutkowski | 5/655 |
| 2003/0177585 | A1 | 9/2003 | Gladney et al. | |
| 2004/0084052 | A1 | 5/2004 | Parker | |
| 2011/0209716 | A1 * | 9/2011 | Scarsbrook | 128/872 |

FOREIGN PATENT DOCUMENTS

| | | | |
|---|---|---|---|
| FR | 2 732 750 | A1 | 10/1996 |
| FR | 2 841 113 | A1 | 12/2003 |
| GB | 2 357 965 | A | 7/2001 |
| WO | WO 97/39661 | A1 | 10/1997 |

OTHER PUBLICATIONS

International Search Report (PCT/ISA/210) issued on Nov. 4, 2010, by French Patent Office as the International Searching Authority for International Application No. PCT/FR2010/051414.

* cited by examiner

*Primary Examiner* — Michael Trettel
(74) *Attorney, Agent, or Firm* — Buchanan Ingersoll & Rooney PC

(57) ABSTRACT

The invention relates to a mat intended for a person for whom some mobility is desired, and who can easily be taken care of while preventing any risk of fall when the person lying on the mat moves and is unattended. Such a secure fall-prevention mat mainly includes a core, holding means intended for holding a person lying on said mat and a ballasted set. As an exemplary preferred embodiment, such a mat is a mat used for changing babies.

15 Claims, 5 Drawing Sheets

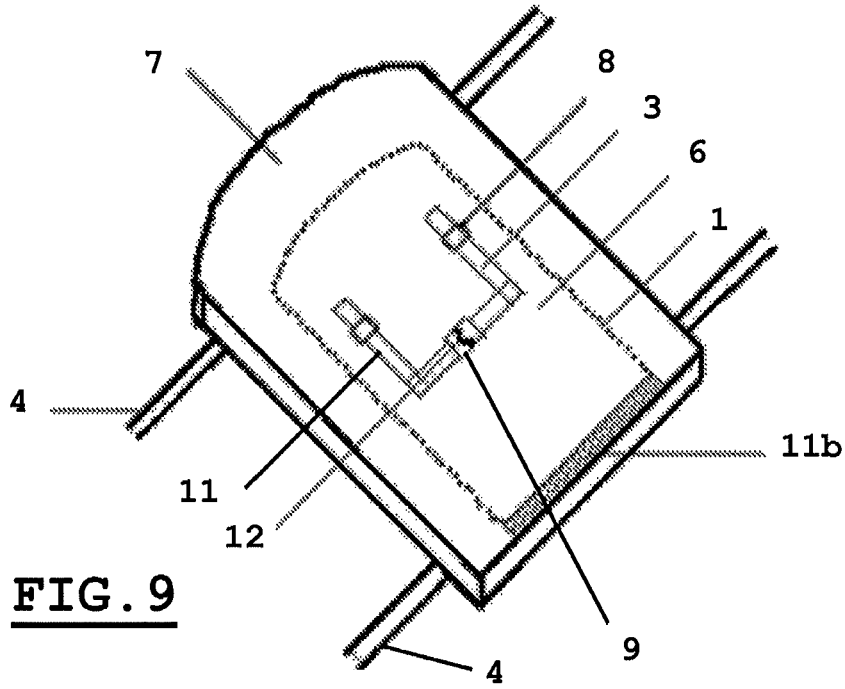
FIG.9
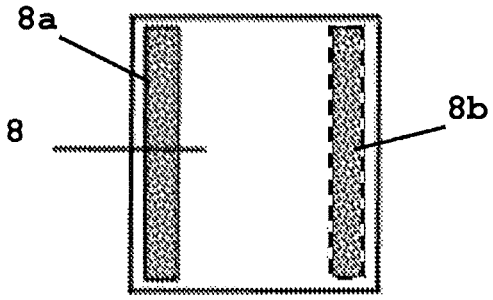
FIG.10
FIG.11
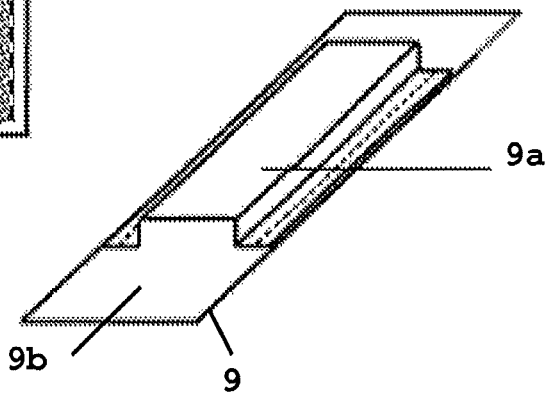

SECURE FALL-PREVENTION MAT

The invention relates to a secure fall-prevention mat intended for preventing the fall of a baby during changing operations. The invention more generally relates to a mat intended for a person, including an adult, for whom some mobility is desired, and who can be taken care of, while preventing any risk of fall when the person lying on the mat moves and is unattended.

Such mats can be used on any support such as a table, a bed, a commode, an armchair, for instance, at home, on in a hospital.

Several types of supports or pieces of changing furniture are currently known on the market. For instance, the current changing mat to be placed on a commode or the conventional changing table which may be equipped with a bath-tub and rest on feet can be mentioned. Such devices offer no protection as regards the fall of the child who can move toward the edges of the table, or the support of the mat, turn around and fall.

Document WO 97/39661 provides for a so-called secure changing mat having two rigid frames which are kept spaced away by crossbars. The upper frame can be folded downwards and is used as a kind of safety belt. This device has many major drawbacks. Among others, we can more particularly mention a lack of stiffness of the safety system with respect to the base of the table. Thus, the fall of the child cannot be efficiently prevented.

Changing mats provided with foldable side and rear faces are also known, more particularly from FR 2 803 733 or FR 2 732 750. The main drawback of such devices is that the front edge of the changing table is free. And fall risks are thus very important. Besides, using such devices is not very easy because of the various operations to be carried out in order to fold the faces.

Document FR 2 841 113 discloses a protective device including a support and a peripheral safety belt. The latter is rigidly and jointedly connected, at one of the ends thereof, to the support by a bow. The other end of the belt is connected to a control system enabling the down motion of the end of said belt, and the automatic up motion thereof. The control system is manually actuated by a lever. The system automatically returns to the active safety position using at least one mechanical or pneumatic spring, in order to control the up motion of the safety belt. This device offers an efficient solution against falls by more particularly enabling the locking of the front face of the changing support. However, it is not easy to use and proves to be very expensive, more particularly because it uses a complex mechanical system. In addition, the position of the springs is such that a risk exists for the child to be pinched or hurt when the safety belt is moved downwards.

The present invention makes it possible to remedy the above-mentioned drawbacks. It provides for a secure mat preventing falls while giving easy access to the person present on said mat, and letting this person move easily. Using a mat according to the invention is very simple. In addition, it can easily be installed and the production cost thereof is very advantageous, from an economical point of view.

For this purpose, the invention provides for a secure fall-prevention mat including a core and holding means intended for holding a person lying on said mat, such that the latter further includes a ballasted set.

The invention provides that the ballasted set of such mat can be made of a flexible, rigid or semi-rigid casing containing ballast.

According to a preferred embodiment, said ballasted casing may include at least two partitions for distributing ballast.

The latter can consist of a fluid or a set of granules or balls.

A mat according to the invention may include holding means which consists in a harness including protective pads on braces and/or a locking buckle.

In addition, the invention provides that such a secure mat may include a cover for covering the ballasted set, as well as the mat core. According to such an alternative solution, said cover includes openings intended for enabling the use of the holding means.

Such a cover may be made of a washable material and, as an alternative solution, can be removed or replaced for hygienic purposes.

The core of a mat according to the invention may consist of foam, a set of fibres or any other means able to provide comfort to the person lying on said mat.

According to a preferred embodiment, the invention provides that such a secure mat can be a secure fall-prevention changing mat. According to this particular embodiment, the ballasted set can, for instance, be horseshoe-shaped, and have dimensions slightly smaller than the mat cover, so that the ballasted set and the core can be introduced into the cover. Besides, the holding means can consist of a harness fixed to the core or to the cover.

According to an alternative solution, a mat according to the invention can also be a secure fall-prevention changing mat, wherein the ballasted set can consist of a shell containing ballast, whereon the core of the mat is placed. Such a shell can then integrate a safety harness and the core and the cover are provided with orifices for introducing the safety harness straps. The cover of such a changing mat may include, on the inner face thereof, attachment means able to cooperate with said shell.

Other characteristics and advantages will appear more clearly when reading the following description and referring to the appended drawings, among which:

FIGS. 5 to 9 show a second embodiment of a mat according to the invention, as a changing mat;

FIGS. 10 and 11 show alternative embodiments for improving comfort and safety of a harness according to FIG. 4.

FIG. 1 is a side perspective view of the top side of a changing mat according to the invention.

According to this first embodiment, the mat is a changing mat for babies.

Such a mat includes a core 6 which is a latex-based component, foam, a set of fibres or springs to provide the child with the requested comfort. The selection of the core material is not limited to the above examples. Such a core can also be made as a cushion.

Figure 2:
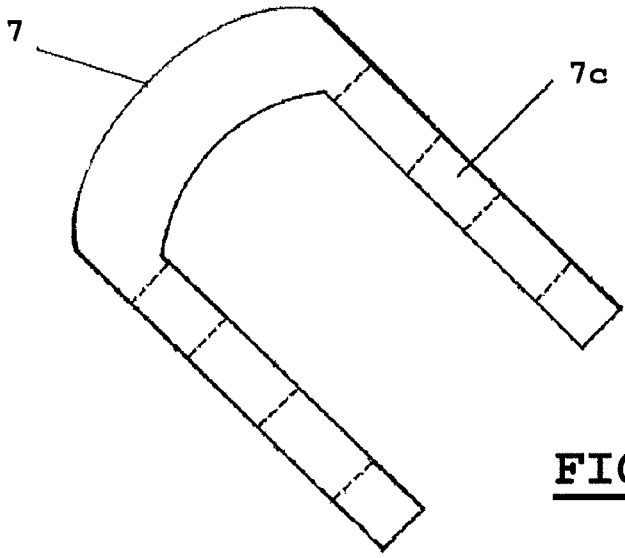

The changing mat also includes a ballasted set 7 as shown, as an exemplary embodiment, in connection with FIG. 2. According to this Figure, the set 7 can be made as a flexible, rigid or semi-rigid casing containing ballast—for example a fluid, sand or particles, like granules or balls.

According to a preferred embodiment, the casing may include a plurality of partitions 7*c*. The partitions aim at a correct distribution of ballast inside the casing and a correct ballasting in case of leakage from, or damage to one or more partitions, among all the partitions.

Besides, in order to facilitate the packaging and transportation of the mat, the invention provides that said ballasted set can be filled and emptied as desired, before and after every utilisation. The ballasted cover, as per FIG. 2, can thus be provided with one or more filling valves, or any other means for filling purposes.

The mat described in connection with FIG. 1 also includes holding means 3 for holding the child on the mat. For instance, said holding means 3 may be a harness such as described hereunder, while referring to FIG. 4.

Figure 4:
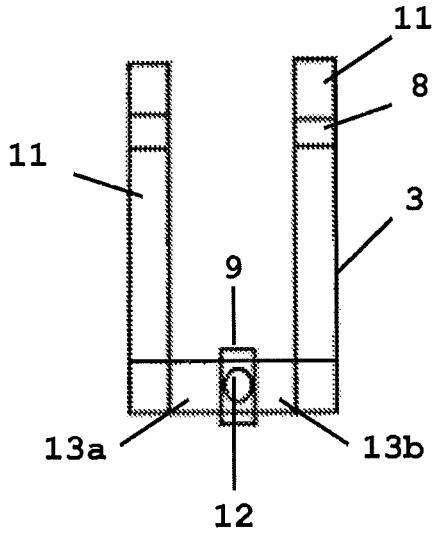
FIG. 4 shows a particular embodiment of the holding means as a harness.

As from this FIG. 4, such harness 3 can thus include, for instance, two braces 11, two lap straps 13*a* and 13*b* and a locking buckle 12. Any other type of means able to hold a child on the mat could be considered. The only criterion is that said means should make it possible to provide the baby with care—more particularly change the child—without having to open or deactivate the holding means.

Figure 1:
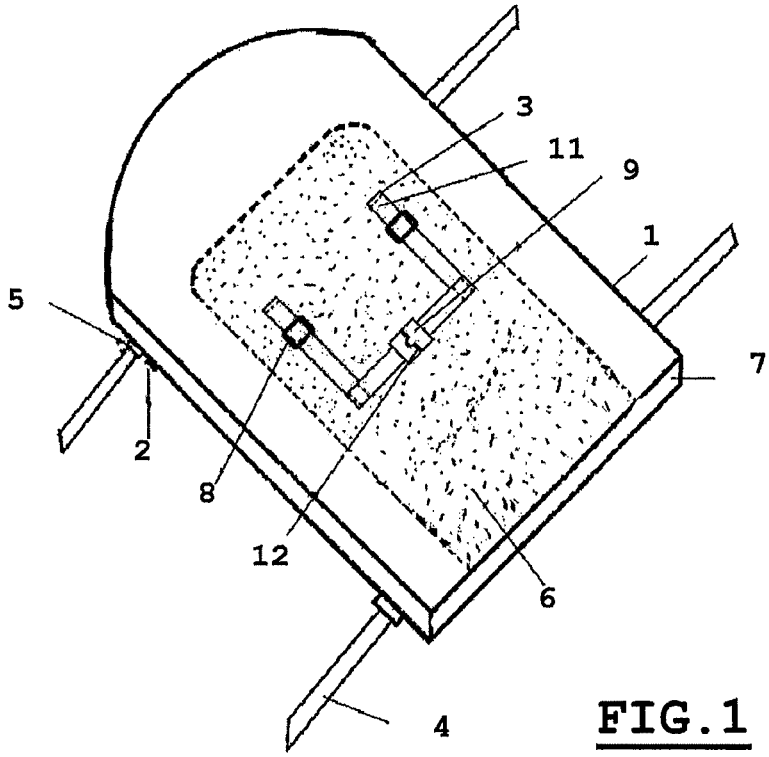
FIGS. 1 to 3 show a first embodiment of a mat according to the invention, as a changing mat.

According to the embodiment described while referring to FIG. 1, such harness 3 may be fixed to the core 6.

It could also be fixed to a cover 1, which is provided for covering the core 6 and the ballasted set 7.

When the holding means are fixed to the core 6, openings or orifices can be provided in said cover for introducing braces, straps and locking buckle(s).

To give a shape to the changing mat and enable a correct core thickness, a ballasted set 7, for instance having a horseshoe shape, can be provided for, as described while referring to FIG. 2. According to this alternative solution, the core is inserted into the horseshoe and the mat can keep a thickness substantially equal to that of the core or the ballasted casing. As an alternative solution, the core can be superimposed on a ballasted set, the surface of which is substantially that of the changing mat, which has a higher thickness than above.

The mat as described in connection with FIG. 1 may have various dimensions, according to the child's morphology. As an example and without prejudice to the present invention, the average dimensions of such a mat can be approximately 55 cm in width and 75 cm in length, and 5 cm in thickness.

Figure 3:
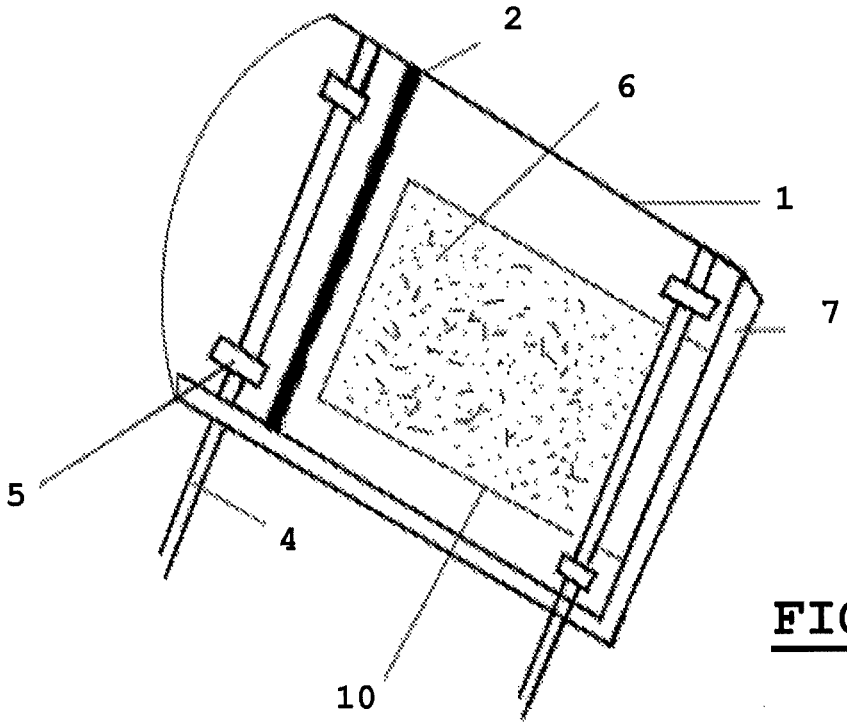

FIG. 3 shows a bottom view of such a changing mat according to the invention.

When the ballasted casing is as described in FIG. 2, the core 6 may be provided such as to be introduced into the cover 1 and sewn 10 thereto to guarantee the holding of the assembly.

FIG. 3 makes it possible to describe an alternative solution wherein one or several attachment straps 4 can be provided for attaching the mat on an adapted support for increasing safety if need be. For this purpose, the cover may include fixing lugs 5 sewn thereto in order to slide said attachment straps 4 into said lugs. As an alternative solution, the straps 4 can be sewn or more generally fixed directly to the cover instead of the lugs 5.

To remove the cover (for washing or changing purposes), an opening can be provided in the cover 1 so that it can be separated from the ballasted set. An adhesive or self-adhesive ribbon 2 can be provided for opening and closing the cover 1.

Such a cover may be made of a washable material (such as terry-cloth) or may be a consumable material to be disposed of after use. As an alternative solution, the invention provides for the utilisation of a draw-sheet positioned on the cover so that the utilisation is easier in public places (highway service areas, hotels, for instance) or in hospitals, day nurseries, etc.

Thanks to the combination of the holding means and the ballasted set, the baby can be changed safely, or even left unattended for a few seconds without risk. As a matter of fact, ballast prevents the mat from turning further to the movements of the child who can still move.

For this purpose, sufficient ballast shall be chosen so as to prevent any turning of the mat. Such ballast can be adapted to the child's corpulence. Tests showed that, for instance, ballast equal to at least the child's weight is enough for giving the desired protection.

The invention provides for a second embodiment of a mat according to the invention. According to an exemplary preferred embodiment, the mat is a changing mat for babies.

Figure 5:
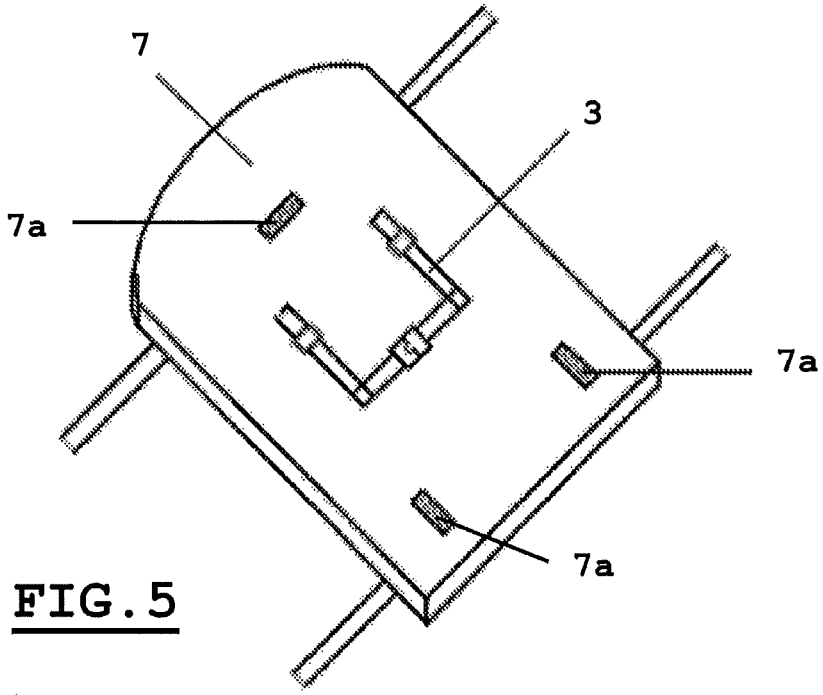
Figure 6:
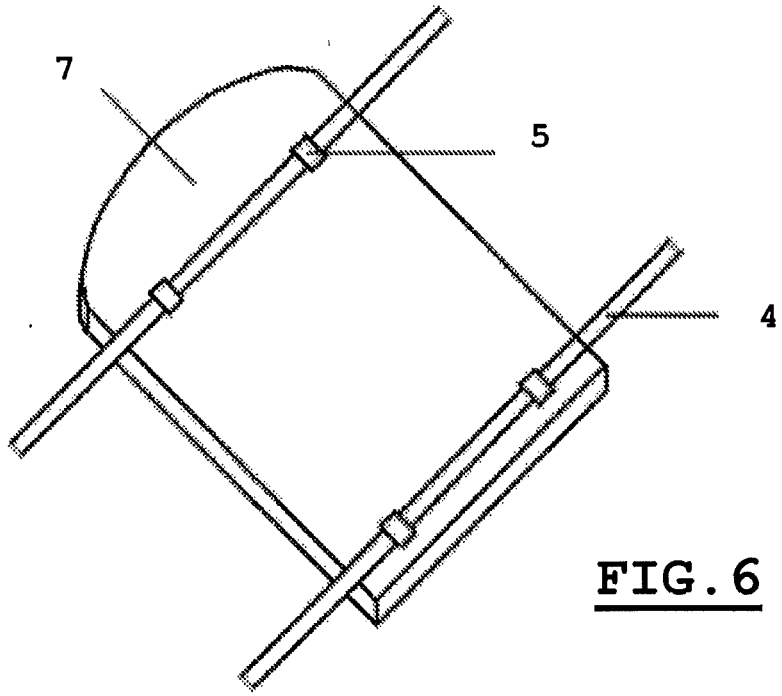

FIGS. 5 and 6 thus respectively show a bottom and a top view of a rigid or semi-rigid shell. The shell 7 may be moulded and includes ballast. This can be a fluid, sand, granules, etc. Ballast can be integrated in the shell prior to using the mat. In an alternative embodiment, the shell 7 may be solid and be, alone, the ballasted element.

According to a first alternative solution, holding means 3—for instance a harness such as described while referring to FIG. 4—is fixed to said shell 7 as shown in FIG. 5. To improve safety or make up for insufficient ballast (resulting from the child's growth, for instance), one or more attachment strap(s) 4 can be provided, as shown in FIG. 6, for attaching the mat on a support. The strap(s) can be made integral with the shell 7 by means of one or more fixing lugs 5. The latter can be attached to shell 7 or moulded with said shell 7. In an alternative embodiment, the attachment strap/straps may be directly attached to the shell 7.

Figure 7:
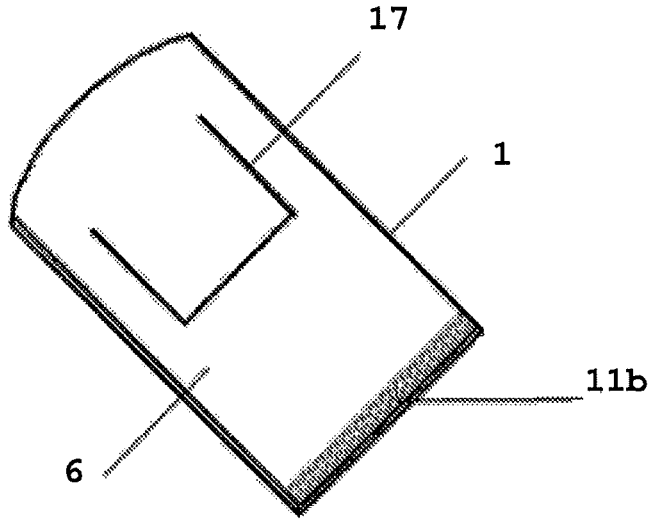

To make a mat integrating a shell such as described while referring to FIGS. 5 and 6, the invention provides for a cover 1 intended for covering the core 6 of a mat made of fibres, foam or any other component conventionally used in a traditional mat. Such a cover is disclosed in connection with FIG. 7. An opening 11*b* may be provided in the cover 1 so as to introduce the core of the mat 6, or to remove it, in order to wash or to change the cover.

To use the holding means 3 attached to the shell 7, one opening 17 can be provided for introducing safety elements (straps, braces, locking buckle(s)) through the cover and the core. A cover such as disclosed in FIG. 7 can be applied to the shell 7, as shown in FIG. 9. The shell 7 assembly associated with the holding means 3, coupled with the cover 1 including the core 6, composes the secure fall-prevention changing mat according to the invention.

Figure 8:
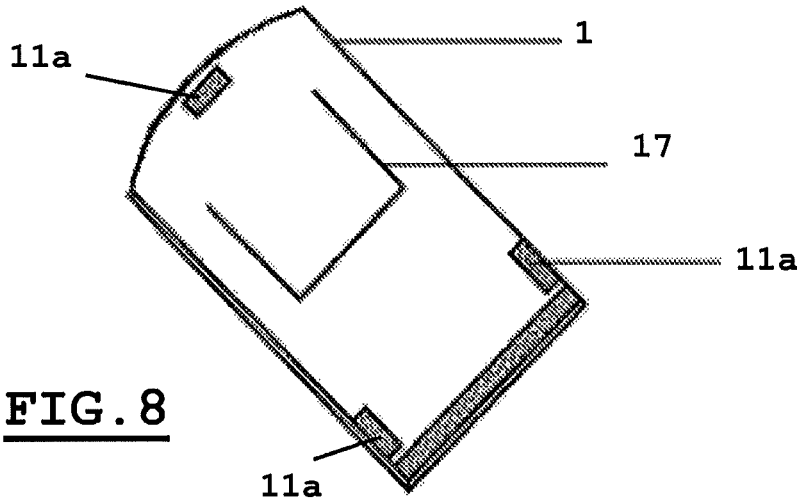

In order to facilitate the holding of the cover on the shell, the invention provides for the possible utilisation of fixing means 11*a*—such as one or more self-adhesive strips—on the back of the cover 1, as shown in FIG. 8. Then fixing means 7*a* are provided opposite, on the upper face of the shell 7—with said means 7*a* being able to cooperate with the means 11*a* on the cover 1.

The invention provides for the possible utilisation of protective means for preventing any risk of injuries caused by the holding means 3—whatever the execution of the mat. FIGS. 10 and 11 thus respectively show an exemplary protection to be provided on a brace or a locking buckle. According to FIG. 10, the invention provides for a possibly stuffed strip of fabric to be wrapped about one brace. Said strip may include two self-adhesive strips 8*a* and 8*b* respectively at the front and the rear of said strip so as to form a sheath 8 to be positioned about one brace. Similarly, FIG. 11 discloses a sheath wherein holding straps, or a locking buckle is/are inserted. The latter does not come in direct contact with the abdomen or any other part of the body. Such a sheath can be made using a pair of cloth strips 9*a* and 9*b* sewn together. This protection 9 can also be provided, as an alternative solution, as a strip 8, as described while referring to FIG. 10 for the braces.

The mat according to the invention has been more particularly described through the application to babies. The invention is not limited to such exemplary preferred application.

Such a mat can thus be adapted to any person, including an adult. The size and volume of the components, and the lest may vary accordingly to be adapted to the mean corpulence and morphology of the people aimed at.

The invention claimed is:

1. A secure fall-prevention mat including a core, holding means intended for holding a person lying on said mat, and a ballasted set comprising a casing arranged to contain a ballast composed of a fluid or semi-fluid, the ballasted set arranged to be substantially coplanar with the core and to surround at least a portion of an outer circumferential periphery of the core.

2. A mat according to claim 1, wherein the casing includes means to introduce or extract the ballast.

3. A mat according to claim 2, wherein the casing includes at least two partitions for distributing the ballast.

4. A mat according to claims 2, wherein ballast consists of a fluid, sand or a set of particles, granules or balls.

5. A mat according to claim 1, wherein it includes at least 2 attachment straps intended for attaching the mat on a support.

6. A mat according to claim 1, wherein the core consists of foam, a set of fibres or any other means able to provide comfort to the person lying on said mat.

7. A mat according to claim 1, wherein the holding means comprises a harness including braces and a locking buckle.

8. A mat according to claim 7, wherein the harness includes protective pads provided on the braces and/or a locking buckle.

9. A mat according to claim 1, further including a cover to cover the core of the mat.

10. A method according to claim 9, wherein the cover is made of a washable material.

11. A mat according to claim 9, wherein the cover may be removed from the mat and replaced.

12. A mat according to claim 9, wherein the cover further covers the ballasted set.

13. A secure fall-prevention mat including a core, holding means intended for holding a person lying on said mat, a ballasted set comprising a casing arranged to contain a ballast composed of a fluid or semi-fluid, and a cover to cover the core of the mat, wherein the ballasted set is horseshoe-shaped and has dimensions slightly smaller than the cover of the mat, so that the ballasted set and the core can be introduced into the cover, and wherein the holding means is fixed to the core or to the cover.

14. A secure fall-prevention mat including a core, holding means intended for holding a person lying on said mat, a ballasted set comprising a casing arranged to contain a ballast composed of a fluid or semi-fluid, and a cover to cover the core of the mat, wherein the ballasted set comprises a shell containing ballast whereon the core of the mat is placed, with said shell integrating a safety harness, and wherein the core and the cover include orifices to enable the introduction of the safety harness straps.

15. A secure fall-prevention mat according to claim 14, wherein the cover includes, on the inner face thereof, fixing means able to cooperate with the shell.

* * * * *